United States Patent [19]

Cox

[11] 4,064,203

[45] Dec. 20, 1977

[54] AIR-CIRCULATING DEVICE WITH AIR FRESHENER, HUMIDIFIER, AND/OR DEODORIZER

[75] Inventor: Dale W. Cox, Hermosa Beach, Calif.

[73] Assignee: Western Magnum Corporation, Hermosa Beach, Calif.

[21] Appl. No.: 724,020

[22] Filed: Sept. 16, 1976

[51] Int. Cl.[2] ..... F24F 3/14; F24F 7/06

[52] U.S. Cl. ..... 261/99; 261/102; 261/104; 98/33 A

[58] Field of Search ..... 261/96, 99, 102, 104, 261/105, 107, DIG. 3, DIG. 34, DIG. 4, DIG. 43; 98/33 R, 33 A

[56] References Cited

U.S. PATENT DOCUMENTS

| | | | |
|---|---|---|---|
| 835,895 | 11/1906 | Smith | 261/DIG. 34 |
| 1,170,551 | 2/1916 | Marty | 98/29 |
| 1,295,416 | 2/1919 | Berry | 261/DIG. 43 |
| 2,032,634 | 3/1936 | Ross | 261/107 |
| 3,173,353 | 3/1965 | Watkins | 98/33 A |
| 3,347,025 | 10/1967 | Wiley | 98/33 R |
| 3,973,479 | 8/1976 | Whiteley | 98/33 A |

FOREIGN PATENT DOCUMENTS

| | | | |
|---|---|---|---|
| 765,612 | 1/1957 | United Kingdom | 261/107 |

*Primary Examiner*—Tim R. Miles
*Assistant Examiner*—Gregory N. Clements
*Attorney, Agent, or Firm*—Allen A. Dicke, Jr.

[57] ABSTRACT

Air-circulating device having an upright tube or passage and a fan for drawing warm air downward from adjacent the ceiling of a room and discharging it adjacent the floor thereof is provided with a liquid reservoir and a wick, with the wick positioned so that the circulating air blows thereover to provide air freshening and humidifying. The reservoir may be adjacent the tube above the fan or may be adjacent the fan outlet. A further modification provides a charcoal or other type filter in the air stream to remove odors, such as cigarette smoke, etc.

4 Claims, 4 Drawing Figures

FIG. 1
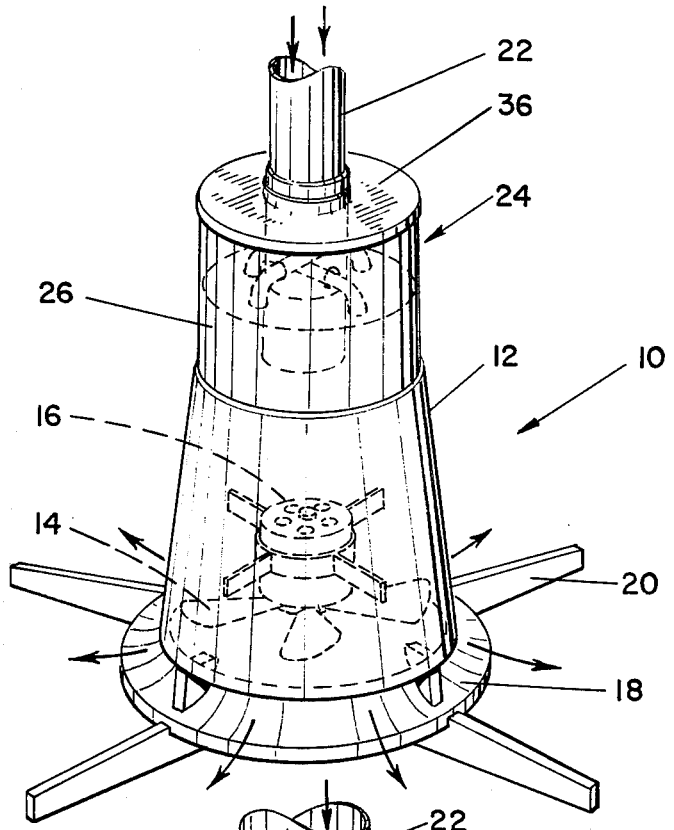
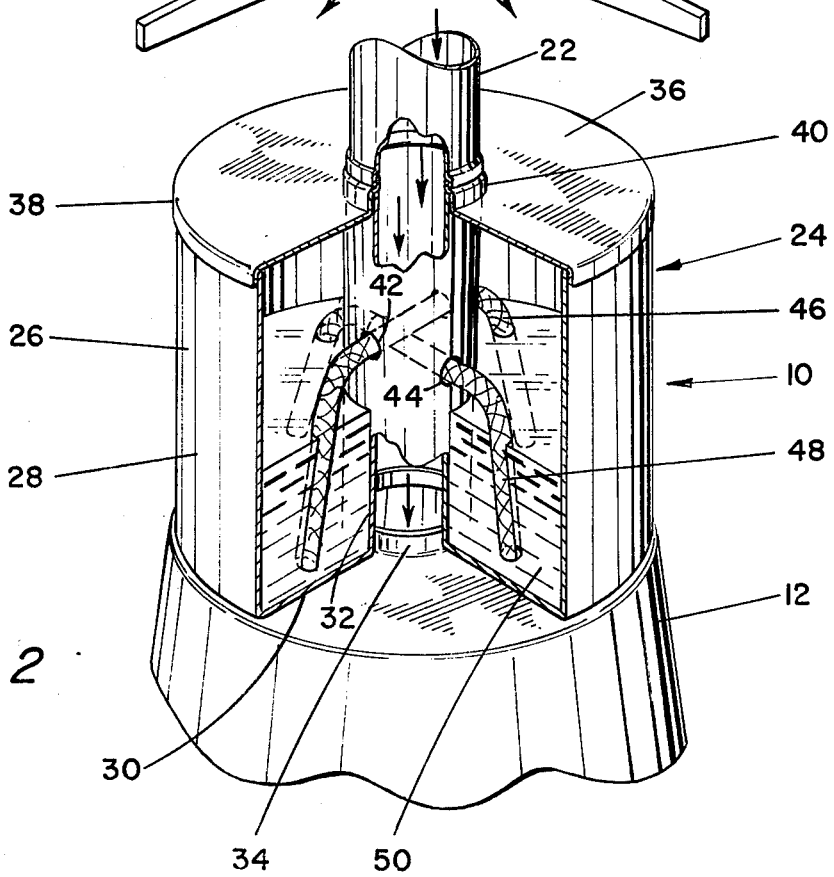
FIG. 2

AIR-CIRCULATING DEVICE WITH AIR FRESHENER, HUMIDIFIER, AND/OR DEODORIZER

BACKGROUND

This invention is directed to an air freshener and humidifier organized in association with an aircirculating device for reducing stratification of room air.

An air-circulating device for reducing stratifi-cation in a room is ornamentally illustrated in U.S. Design Pat. No. 239,940. That patent illustrates a structure which has an electric motor-driven fan located in a base mounted on or adjacent the floor. The fan inlet includes an elongated tube which extends upward to terminate adjacent the ceiling of the room. In those rooms which are radiantly heated, there is no forced circulation, as is found in spaces heated by forced air furnaces. In tests of a radiantly heated room, air was found to stratify with an air temperature adjacent the ceiling as much as 26 degrees above the air temperature adjacent the floor without the benefit of an air-circulating device with air freshener and humidifier, as described in this application. When the air-circulating device was turned on, stratification was reduced to 5°. This reduction in stratification improves floor level comfort and thus permits reduction in thermostat setting with consequent saving in heat energy.

While steam radiators and hot water convectors provide a temperature differential which causes convective circulation, this convective circulation still permits a considerable amount of stratification which results in excessive ceiling temperatures and cool floor temperatures. In a group of apartments heated by a central oil-fired hot water furnace, the oil consumption was 5.131 gallons per degree day over a two-year test period. During a full year test after installation of air-circulating devices for reducing stratification, the consumption was 4.307 gallons per degree day. This is a reduction of 16 percent. In one year of operation, the reduction in fuel cost equaled about twice the cost of the air-circulating device. Thus, an air-circulating device with air freshener and humidifier not only reduces the room stratification to improve heating comfort and efficiency, but also adds moisture and provides air freshening.

SUMMARY

In order to aid in the understanding of this invention, it can be stated in essentially summary form that it is directed to an air-circulating device with air freshener and humidifier. The device includes a fan for circulating room air with a humidifier reservoir and wick positioned along the path of air flow caused by the circulating fan.

It is thus an object of this invention to provide an air-circulating device which includes a humidifier with the humidifier having a reservoir and a wick for supplying liquid from the reservoir to the air stream, the liquid being either water or water containing an air freshener solution. It is a further object of this invention to provide air-circulating device which provides the benefits of both air circulation and humidification in a single unit to reduce stratification to reduce heating cost and freshen air. It is another object to provide an air-circulating device with an air freshener and humidifier structure which also is capable of containing a charcoal or other filter for the active removal of odors from the circulating air.

Other objects and advantages of this invention will become apparent from the study of the following portion of this specification, the claims, and the attached drawings.

BRIEF DESCRIPTION OF THE DRAWINGS

FIG. 1 is a perspective view of a first preferred embodiment of the air-circulating device with air freshener and humidifier structure in accordance with this invention.

FIG. 2 is an enlarged perspective view, with parts broken away and parts taken in section, showing further details of the device of FIG. 1.

DESCRIPTION OF THE PREFERRED EMBODIMENT

Figure 3:
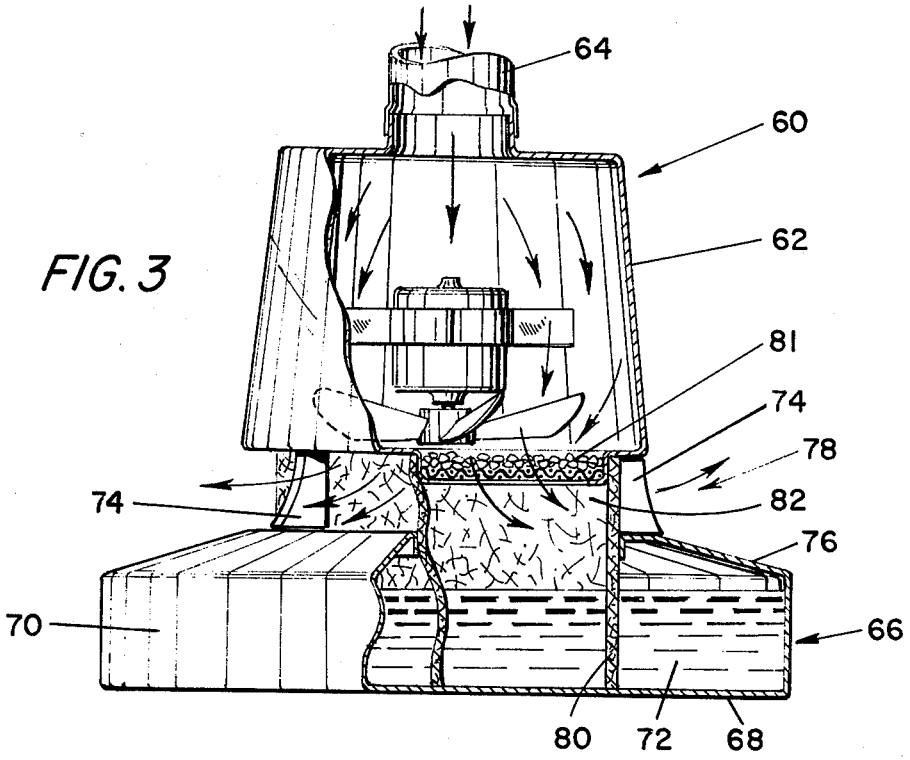
FIG. 3 is a side-elevational view, with parts broken away and parts taken in section, showing a second preferred embodiment of the air-circulating device with air freshener and humidifier of this invention.

FIGS. 1 and 2 illustrate the first preferred embodiment of the air-circulating device with air freshener and humidifier of this invention. The device is generally indicated at 10. The device comprises fan housing 12 which contains therein fan 14 driven by fan motor 16 which is mounted on motor support arms which extend inwardly from the frusto-conical wall of the hollow fan housing. In its outlet, the fan housing has an activated charcoal adsorber better seen in FIG. 3. From there, the air stream passes downward into diffuser 18 which is in the form of a deflector which directs the downwardly flowing air within fan housing 12 into a generally radially outward directed flow adjacent the bottom of the device. Support feet 20 are positioned under diffuser 18 to support the device. The device also comprises inlet tube 22 which extends upward to a location adjacent the ceiling to draw ceiling level air downward to be discharged out of the diffuser adjacent the floor. The device also comprises air freshener and humidifier 24.

Toroidal reservoir 26 has an outer tubular wall 28, bottom wall 30, and inner tubular wall 32. As is best seen in FIG. 2, reservoir 26 is dimensioned so that it rests on the substantially flat top of fan housing 12. Furthermore, fan housing 12 has an upstanding ring 34 which surrounds the air inlet into the fan housing and serves as a male connector. Inner tubular wall 32 embraces ring connector 34 so that the interior passage through inner tubular wall 32 is an extension of inlet tube 22. Cap 36 has a downwardly extending flange 38 which engages over the top of outer tubular wall 28 to enclose the top of the reservoir. It has a central collar 40 which has an interior recess which receives the top end of inner tubular wall 32 and, above that, has a male ring connector to engage into the bottom of inlet tube 22. In this way, the reservoir is closed, and air flow continuity through the interior tube is achieved.

Transverse openings 42 and 44 open the reservoir to the interior of the tube, and wicks 46 and 48 extend from adjacent the bottom of the reservoir up through the transverse openings so that liquid in the reservoir is wick-fed into the inner tube defined by wall 32 so that air flow induced through that tube passes over the moistened wicks.

Liquid 50 in reservoir 26 can be placed therein by removing cap 36 and filling to a level below opening 44. Thereupon, cap 36 and inlet tube 22 are replaced. The liquid filled into the reservoir can be water for humidifying the air or it can include an air freshener solution, such as chlorophyll which, when evaporated into the air, condenses odorous vapors. In this way, not only is the temperature stratification of the air reduced, but the air is humidified and freshened.

The air-circulating device 60 with air freshener and humidifier is shown in FIG. 3 and has fan housing 62 and inlet tube 64, respectively, the same as fan housing 12 and inlet tube 22 of device 10. Fan housing 62 contains a motor and a fan, the same as fan housing 12; however, instead of resting upon a diffuser and support feet, fan housing 62 rests on reservoir 66. Reservoir 66 has bottom 68 and side wall 70 to contain liquid 72. Upstanding ribs 74, of which there are at least three, support the bottom of fan housing 62 above reservoir top 76 to define radially directed air outlet space 78 therebetween. Reservoir top 76 can have an opening for the introduction therein of the liquid, or fan housing 62 can be lifted off to permit the pouring in of the liquid. Finally, cylindrical wick 80 extends upward from the bottom of the reservoir and across the outlet space 78 so that downflowing air exits through the wick and radially out through space 78. Liquid 72 can be water or can be an air freshener solution, as previously described. By this structure, stratification of the air in the room is reduced, humidity is increased, and (when air freshener is used) odors are condensed. Additionally, a structure of sbsorbent material, such as activated charcoal, can be placed in the system, Adsorber 81 preferably comprises a disc of loosely agglomerated charcoal or charcoal resting on a screen which is positioned in the outlet 82 of fan housing 62. On the other hand, such a structure can be tubularly shaped and can be placed interiorly or exteriorly of cylindrical wick 80 in the outlet path of the air out of outlet space 78.

Figure 4:
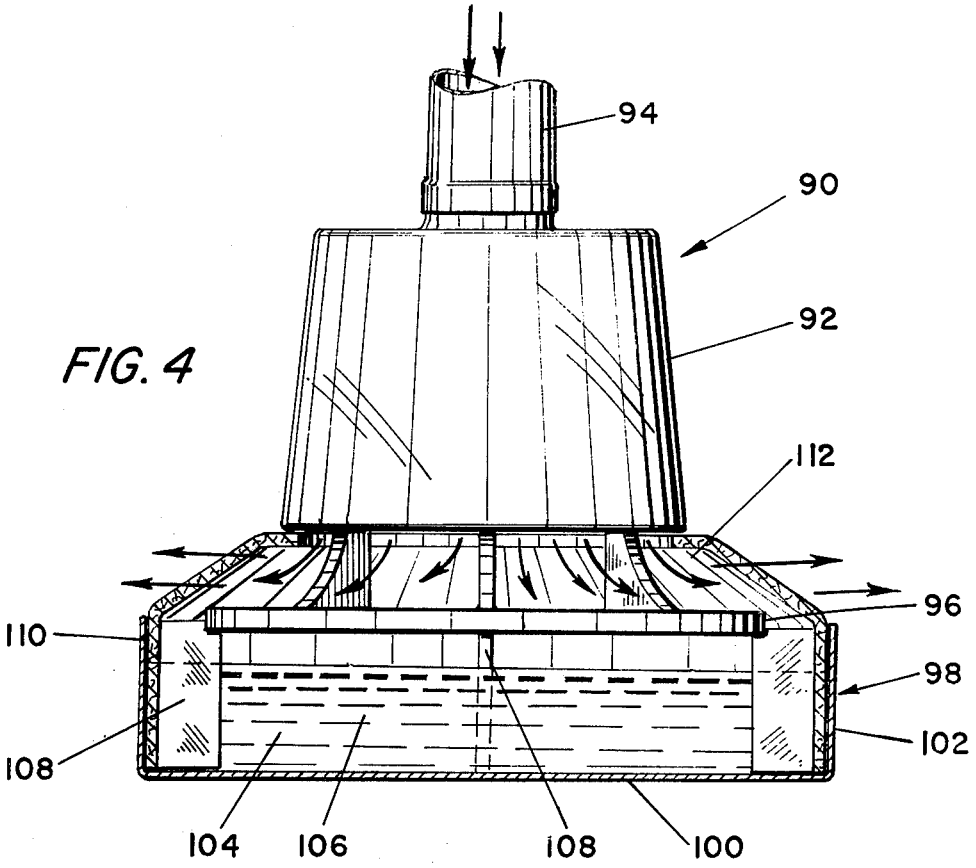
FIG. 4 is a side-elevational view, with parts broken away and parts taken in section, of another preferred embodiment of the air-circulating device with air freshener and humidifier of this invention.

Device 90 illustrated in FIG. 4 is another preferred embodiment of the air-circulating device with air freshener and humidifier of this invention. In device 90, fan housing 92 has an air inlet tube 94 connected at its top and diffuser 96 connected at its bottom identically to fan housing 12, air inlet tube 22 and diffuser 18 of the device illustrated in FIG. 1. Reservoir 98 has bottom 100 and side walls 102 to define reservoir space 104 for containing liquid 106. Webs 108 (of which there are at least three) extend upward from the bottom of the reservoir to engage on the bottom of diffuser 96 to support the diffuser and the entire upper structure. Tubular wick 110 extends down into the reservoir inside of side walls 102 and extends upward past the diffuser outlet space 112 and is bent in across the diffuser outlet space and engages under fan housing 92. Thus, the circulating air passing outward from the diffuser passes through the upper portion of wick 110. Wick 110 is fed by liquid 106 so that air passing through the wick is moistened. As previously described, the moisture may be water or may contain an air-freshening solution so that stratification of room air is reduced, humidity is increased, and the air is freshened.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A portable air-circulating and humidifying device comprising:

a fan housing, a fan blade and a fan motor associated with said fan housing to draw air through said housing;

walls defining an outlet space below said fan housing for delivering air from said fan housing back into said from below said air inlet to circulate air in the room and reduce stratification;

a wick and a liquid reservoir, said reservoir being positioned on top of said fan housing and having an inner tubular air passage therethrough, an inlet tube detachably mounted on top of said reservoir and in communication with said air passage therethrough, said inlet tube serving as an air inlet passage to said reservoir and said housing, said air inlet tube extending upward from said housing to an elevated position for withdrawing air from above said fan housing, said inner tubular air passage through said reservoir extending between said inlet tube and said fan housing, said wick extending into said air passage within said reservoir.

2. The device of claim 1 wherein said reservoir is annular with an air passage adjacent the center thereof.

3. A portable air-circulating and humidifying device comprising:

a fan housing, a fan blade and a fan motor associated with said fan housing to draw air through said housing;

an inlet tube detachably mounted on top of said fan housing to serve as an air inlet passage to said fan housing, said air inlet tube extending upward from said housing to an elevated position for withdrawing air above said fan housing;

an outlet space below said fan housing and a diffuser wall below said fan housing defining said outlet space so that said fan housing discharges air onto said diffuser wall from above and said diffuser wall has a generally radially outward directed outlet space below said fan housing for delivering air from said fan housing back into said room below the air inlet to circulate air in the room and reduce stratification; and a wick and a liquid reservoir, said reservoir having support means therein for supporting said diffuser, said wick extending upward out of said reservoir and being positioned outwardly from said diffuser so that air from said fan housing is delivered outwardly through said wick to humidify the air.

4. The device of claim 3 wherein said fan housing is directly supported on said diffuser and said diffuser is directly supported within said reservoir.

* * * * *